United States Patent [19]

Bennett

[11] Patent Number: 4,732,287

[45] Date of Patent: Mar. 22, 1988

[54] CONTAINER AND APPLICATOR FOR FLUIDS

[75] Inventor: Robert A. Bennett, Easton, Conn.

[73] Assignee: R.J.S. Industries, Inc., Marlboro, N.J.

[21] Appl. No.: 107,158

[22] Filed: Oct. 13, 1987

Related U.S. Application Data

[63] Continuation-in-part of Ser. No. 931,543, Nov. 17, 1986.

[51] Int. Cl.[4] ..... B65D 17/32

[52] U.S. Cl. ..... 215/32; 222/541; 401/129; 401/132

[58] Field of Search ..... 215/1 C, 31, 32; 206/229, 621; 222/541; 401/119, 126, 127, 129, 132

[56] References Cited

U.S. PATENT DOCUMENTS

| | | | |
|---|---|---|---|
| 571,456 | 11/1896 | Reeves | 401/129 |
| 2,814,420 | 11/1957 | Elder, Jr. et al. | 222/541 |
| 3,416,712 | 12/1968 | Shastal | 222/541 |
| 3,460,724 | 8/1969 | Chmela | 222/541 |
| 3,907,144 | 9/1975 | Winkler | 215/32 |
| 4,157,765 | 6/1979 | Golebiewsky | 222/541 |
| 4,284,199 | 8/1981 | Bigarella | 222/541 |
| 4,290,706 | 9/1981 | Wandl | 401/129 |
| 4,506,793 | 3/1985 | MacGregor et al. | 215/32 |
| 4,558,793 | 12/1985 | Hansen | 215/32 |
| 4,632,240 | 12/1986 | Goncalves | 401/129 |

FOREIGN PATENT DOCUMENTS

| | | | |
|---|---|---|---|
| 946208 | 12/1948 | France | 401/132 |

*Primary Examiner*—David T. Fidei

[57] ABSTRACT

A vertical hollow plastic cylinder having a first outer diameter is open at an upper end and closed at a lower end is adapted to store fluid. A vertical hollow plastic member has upper and lower open ends and, as viewed in a horizontal plane has a circular cross section. The upper end of the member has a second outer diameter, the lower end of the member having a third outer diameter. The second diameter is equal to the first diameter and is larger than the third diameter. The member has an exposed inner surface having the general shape of a bowl and extending downwardly and inwardly from the upper end to the lower end of the member. The outer surface of the member has a first upper vertical section having the second diameter and a second lower vertical section having the third diameter. The first and second sections are interconnected by a horizontal shoulder. The second section is disposed within the upper end of the cylinder with the outer surface of the second section being flush with the inner surface of the cylinder. The upper end of the cylinder is flush with the inner surface of the cylinder, the upper end of the cylinder engaging and being sealed to the shoulder. A vertically elongated plastic element has an upper end disposed above the member and extends downwardly through the member into the cylinder. The element has a lower end disposed below the second section and has a vertical bore which extends upwardly from the lower end of the element to a point intermediate the ends of the element. Vertical bristles are secured in the bore and extend out of the element into the cylinder. A horizontal annular breakable seal is disposed between the element and the inner surface of the lower end of the member to seal the element to the member.

4 Claims, 6 Drawing Figures

26
12
18
22
14
20
26
32
10

26
12
18
16
24
14
26
30
34
10
32

26
12
16
18
20
14
28
10
32

26
32
18

12
26
28
10

10

CONTAINER AND APPLICATOR FOR FLUIDS

CROSS REFERENCE TO COPENDING APPLICATIONS

This application is a continuation-in-part of a copending application having the same title, Ser. No. 931,543, filed Nov. 7, 1986.

BACKGROUND OF THE INVENTION

Potential users of cosmetic fluids such as nail polish do not want to purchase relatively larger containers of fluids which may prove to be unsatisfactory after purchase. For example, a nail polish color as displayed on the container may appear to be satisfactory before actual use, but may be found to be unsatisfactory when the polish is actually applied to the nails. It is, of course, possible for a potential user to purchase the container and throw it away after one unsatisfactory application, but such action is obviously costly and undesirable. The same problem arises when purchases of cans of paint or other fluid materials are made.

SUMMARY OF THE INVENTION

A primary object of this invention is to provide a new type of small leakproof container and applicator of fluids which is inexpensive and can be even thrown away after use and which will enable a prospective user to test use a small quantity of fluid before deciding whether or not to purchase a larger container of fluid. For example, when the fluid is nail polish, the new type of container may contain only enough polish to enable the user to test a single coat on all ten nails.

A container and applicator, in accordance with the principles of the present invention, utilizes a vertical plastic cylinder having a hollow interior chamber adapted to store the desired fluid. The cylinder has an open upper end and a closed lower end and has a first outer diameter.

A vertical hollow plastic member is also utilized. This member as viewed in a horizontal plane has a circular cross section. The member has an open upper end having a second outer diameter equal to the first diameter and has an open lower end having a third and smaller outer diameter. The member has an exposed inner surface having the general shape of a bowl and extending downwardly and inwardly from the upper end to the lower end.

The outer surface of the member defines a first vertical upper section having the second diameter and a second lower vertical section having the third diameter. The first and second sections are interconnected by a horizontal shoulder. The second section is disposed within the upper end of the cylinder with the outer surface of the second section being flush with the inner surface of the cylinder. The upper end of the cylinder engages and is sealed to the shoulder.

A vertically elongated plastic element has an upper end disposed above the member and extends downwardly through the member into the cylinder. The element has a lower end disposed below the second section and also has a vertical bore which extends upwardly from the lower end of the element to a point intermediate the ends of the element. Vertical bristles are secured in the bore and extend out of the lower end of the element into the cylinder.

Horizontal annular sealing means disposed between the element and the inner surface of the lower end of the member seals the element to the member. The means is adapted to be broken by manual pressure to enable the element with its bristles to be removed from the member and the cylinder so that, when the cylinder contains fluid, the element can be used as a handle to repeatedly dip the bristles in the fluid to charge the bristles with fluid for repeated application as desired by a user.

The manual pressure can be exerted by holding the cylinder in one hand and rotating and/or pivoting the element with the other hand.

The container and applicator will not leak before the seal is broken and when fluid is disposed in the cylinder, the container and applicator can be stored for months before use. Once the seal is broken to expose the fluid to air, the fluid must be used immediately since it may deteriorate with such exposure. In any event, the element cannot be resealed to the remainder of the structure because of subsequent leakage problems.

The foregoing and other objects and advantages of the invention will either be explained or will become apparent to those skilled in the art when this specification is read in conjunction with the accompanying drawings.

DETAILED DESCRIPTION OF PREFERRED EMBODIMENTS

Figures 1, 2, 3, 4, 5, 6:
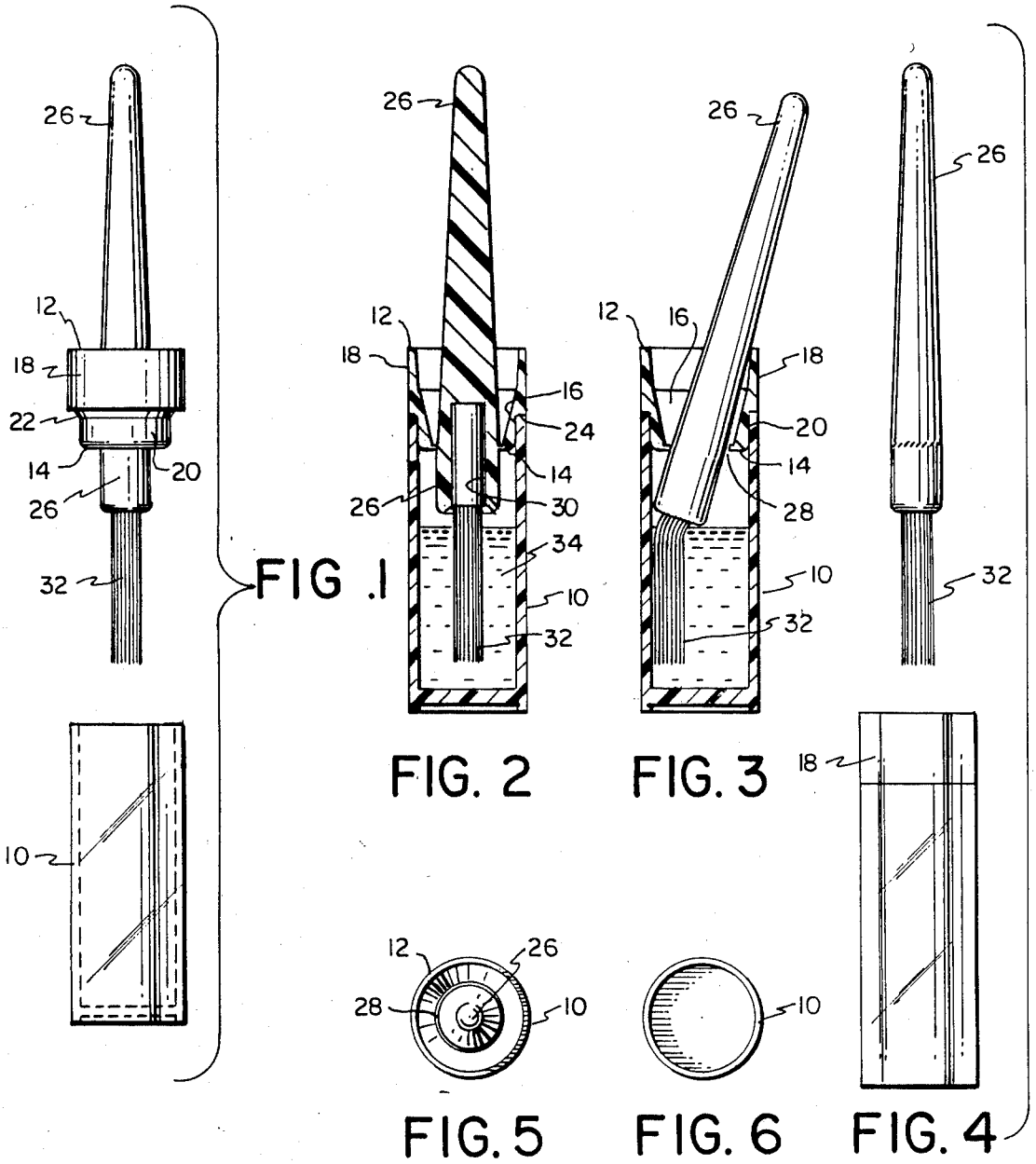
FIG. 1 is a vertical exploded view showing different components of a preferred embodiment of the invention.
FIG. 2 is a vertical cross sectional view of the embodiment of FIG. 1 with the components assembled and interconnected.
FIG. 3 is a view similar to FIG. 2 but illustrating the step of breaking the seal.
FIG. 4 is a view similar to FIG. 3 but illustrating separation of the element and bristles from the remainder of the structure.
FIG. 5 is a top view of the structure shown in FIG. 2.
FIG. 6 is a bottom view of the structure shown in FIG. 2.

Referring now to FIGS. 1–6, there is shown a vertical hollow plastic cylinder 10 having an upper open end and a lower closed end and having a first outer diameter.

A vertical hollow plastic member, which as viewed in a horizontal plane has a circular cross section, has an upper end 12 with a second outer diameter equal to the first diameter and a lower end 14 with a third and smaller outer diameter. The member has an exposed inner surface 16 which has the shape of a bowl and which extends downwardly and inwardly from the upper end to the lower end.

The outer surface of the member defines a first vertical upper section 18 having the second diameter and a second vertical lower section 20 having the third diameter. These two sections are interconnected by an outer horizontal shoulder 22 which extends downwardly and inwardly from section 18 to section 20. The member engages the cylinder with section 18 disposed above the upper end of the cylinder. The upper end of the cylinder engages and is sealed to the shoulder as shown at 24. The outer surface of section 20 is flush with the inner surface of the cylinder.

An elongated plastic element 26 has an upper end disposed above the member and cylinder and extends downwardly through the member into the cylinder. Breakable horizontal annular sealing means 28 disposed between the element and the inner surface of open lower end 14 seals the element to the member.

Element 26 has a vertical bore 30 which extends upwardly from the lower end of the element to a point or position intermediate the ends of the element and, more particularly, between the shoulder and upper end 12. Vertical bristles 32 are secured in the bore and extend out of the lower end of the element into the cylinder.

The seal between the element and the member can be broken as previously described to enable the element to be broken away from the member and removed from the container to expose the opening of upper end 12. The plastic used should be stiff and should be brittle enough to enable the breaking action to take place. A plastic known by the tradename BEREX can be used for this purpose.

In assembling the container and applicator, the element with the bristles in place is first inserted in the member and, with the element and member held in proper position, the element and member are sonically welded together. After a suitable fluid 34, such as nail polish or other material, is poured into the cylinder, the member with the element attached is inserted into the cylinder until the upper end of the cylinder engages the shoulder. The shoulder and upper end of the cylinder are then sealed together by sonic welding or other means. The fluid cannot react chemically with the plastic used. Chemically inert plastics of the type described are well known.

A reverse process of assembly, wherein the member is first inserted into the cylinder and is sealed thereto, and the element is subsequently inserted into the member and is sealed thereto, was found to be unsatisfactory because the element could not be properly sealed in the member when the member had first been secured in the cylinder.

While preferred embodiments of the invention have been described above, it will be apparent to those skilled in the art that numerous modifications thereof can be made without departing from the invention as defined by the scope of the claims that follow.

What is claimed is:

1. A container and applicator for fluids comprising:

a vertical plastic cylinder having a first outer diameter and a hollow interior chamber adapted to store fluid, the cylinder having upper and lower ends, the lower end being sealed;

a vertical hollow plastic member having upper and lower open ends and as viewed in a horizontal plane having a circular cross section, the upper end of the member having a second outer diameter, the lower end of the member having a third outer diameter, the second diameter being equal to the first diameter and being larger than the third diameter, said member having an exposed inner surface having the general shape of a cup and extending downwardly and inwardly from the upper end of the member to the lower end of the member, the outer surface of the member defining a first upper vertical section having the second diameter and a second lower vertical section having the third diameter, the first and second sections being interconnected by a horizontal shoulder, the second section being disposed within the upper end of the cylinder with the outer surface of the second section being flush with the inner surface of the cylinder, the upper end of the cylinder engaging and being sealed to the shoulder;

A vertically elongated plastic element having an upper end disposed above the member and extending downwardly through the member into the cylinder, the element having a lower end disposed below the second section, the element having a vertical bore which extends upwardly from the lower end of the element to a point intermediate the ends of the element;

vertical bristles secured in said bore and extending out of the lower end of the element into the cylinder; and horizontal annular sealing means disposed between the element and the inner surface of the lower end of the member to seal the element to the member, said means being adapted to be broken by manual pressure to enable the element with its bristles to be removed from the member and the cylinder so that, when the cylinder contains fluid, the element can be used as a handle to repeatedly dip the bristles in the fluid to charge the bristles with fluid for repeated application as desired by a user.

2. The container and applicator of claim 1 wherein the point is disposed above the shoulder.

3. The container and applicator of claim 1 wherein the cylinder contains fluid.

4. The container and applicator of claim 1 wherein the shoulder extends downwardly and inwardly from the first section to the second section.

* * * * *